United States Patent [19]

Nevo-Hacohen

[11] Patent Number: 4,820,107

[45] Date of Patent: Apr. 11, 1989

[54] DELIVERY VESTIBULE SYSTEM AND METHOD FOR AUTOMOBILE CONVEYOR GARAGING AND OTHER STORAGE AND RETRIEVAL FUNCTIONS

[75] Inventor: Jacob I. Nevo-Hacohen, Brookline, Mass.

[73] Assignee: Auto-Veyor, Inc., Brookline, Mass.

[21] Appl. No.: 131,242

[22] Filed: Dec. 7, 1987

Related U.S. Application Data

[63] Continuation of Ser. No. 870,847, Jun. 5, 1986, abandoned.

[51] Int. Cl.[4] ..... B65G 17/18

[52] U.S. Cl. ..... 414/261; 198/800; 414/238

[58] Field of Search ..... 414/235–238, 414/241, 247–249, 261, 266; 198/798–800

[56] References Cited

U.S. PATENT DOCUMENTS

| | | | |
|---|---|---|---|
| 1,871,372 | 8/1932 | James | 198/799 X |
| 1,875,183 | 8/1932 | Spriggs | 198/799 |
| 2,473,126 | 6/1949 | Alexander | 105/436 |
| 3,197,045 | 7/1965 | Nevo-Hacohen | 214/16.1 |
| 3,202,115 | 8/1965 | Jones, Jr. | 198/798 X |
| 3,405,795 | 10/1968 | Mascherper | 414/235 X |
| 3,447,666 | 6/1969 | Nevo-Hacohen | 198/158 |
| 3,786,942 | 1/1974 | Dane, Jr. | 414/266 |
| 4,493,414 | 1/1985 | Nevo-Hacohen | 198/800 |

*Primary Examiner*—Peter R. Brown

*Attorney, Agent, or Firm*—Rines and Rines; Shapiro and Shapiro

[57] ABSTRACT

A novel delivery method and vestibule system for underground and similar conveyors, particularly longitudinally traveling conveyors carrying successive automobile-storage platforms, involving under an open vestibule floor area, conveyor loop structures that carry the platform upwardly into the open floor area for car delivery or removal, with automatic gating and walkway insertion to permit safe parking or retrieval of the car by the owner without attendant assistance, other than car platform selection and platform delivery command.

6 Claims, 4 Drawing Sheets

Figure 1C:
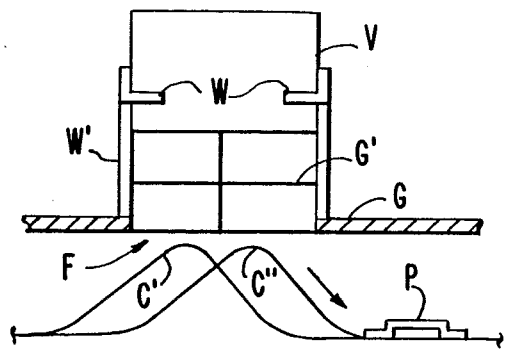

DELIVERY VESTIBULE SYSTEM AND METHOD FOR AUTOMOBILE CONVEYOR GARAGING AND OTHER STORAGE AND RETRIEVAL FUNCTIONS

This is a continuation application of Ser. No. 870,847, filed June 5, 1986, now abandoned.

The present invention relates to delivery vestibules for automobile conveyor garages and the like, as of the type, for example, disclosed in my earlier U.S. Pat. Nos. 3,197,045, 3,447,666 and 4,493,414; being, however, more generally applicable to storage and presentation or retrieval systems and more particularly those employing conveyors.

The safety and convenience of the delivery or presentation zone for acceptance and retrieval (or inspection or presentation) of, for example, automobiles carried by an underground or other continuous conveyor, as in said Letters Patent, are primary areas of concern in the practical application of such systems. Elevator garages that move up and down and sideways involve the conventional alinement of a car driven onto or from the elevator floor of an exit-entrance space. With the automated systems of said Letters Patent and other similar systems, such elementary delivery techniques are, however, not applicable, being incapable of accommodating conveyors with multiple-space-load-carrying platforms, which require additional areas for each platform, imposing a negative effect on the over-all efficiency considering the useful platform areas in relation to the total floor or building area. This is especially true under circumstances where the vehicle operator is to drive the car to a delivery zone, step out and away from the zone, and then the automatic storage system is to remove the car from the zone; or vice versa, and all without the need for handling by attendants or for further activation or driving of the car, once delivered, until the owner retrieves the car from its storage.

An object of the present invention, accordingly, is to provide a new and improved method of and vestibule system for safe, economic and space-efficient delivery and retrieval (or presentation) of automobiles or other objects automatically stored by conveyor apparatus and the like.

A further object is to provide a novel delivery, storage and retrieval system of more general utility, as well.

Other and further objects will be explained hereinafter and are more particularly pointed out in the appended claims.

In summary, from perhaps the broadest viewpoint of its underlying methodology, the invention embraces a method of delivering and retrieving loads to and from platforms carried along a longitudinally extending path by a conveyor moving the platforms to and from the floor area of a vestibule volume, that comprises, looping the conveyor transversely out of the longitudinal path and upwardly to the floor area and then transversely downwardly back along said longitudinal path; moving the conveyor along the loop to carry successive platforms up into alinement with the floor area and then down again and along said path; stopping a preselected platform when carried into alinement with said floor area; and thereafter, following any of retrieval, inspection or insertion of a load at the platform, removing the platform from said floor area by carrying the same transversely down the loop and longitudinally along said path. This technique has a decided effect on the efficient use of the building area and volume on each of the carrying platforms, and their spacing along the conveyor. In the application to automobile garaging and similar applications, the invention also involves automatic insertion of walkways to the side of the platform when it has been stopped in the open floor area of the vestibule. Preferred and best mode embodiment details are hereinafter presented.

Figure 1B:
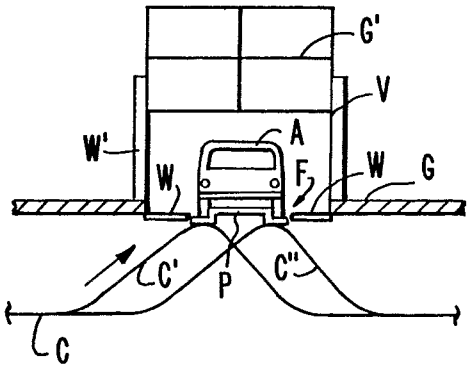
Figure 1A:
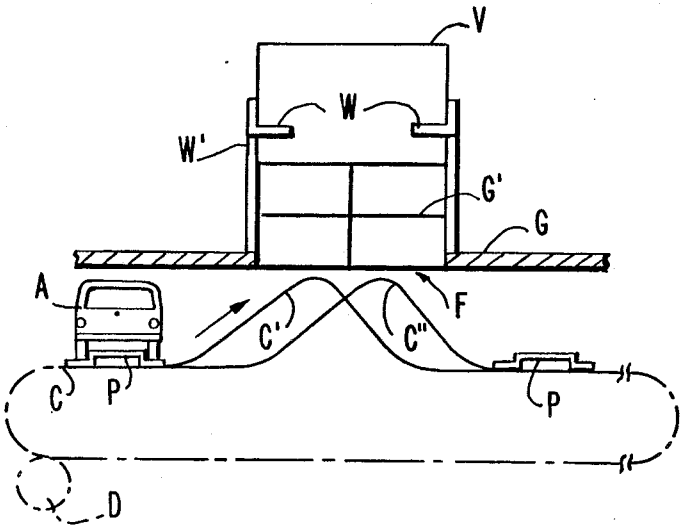
Figure 2C:
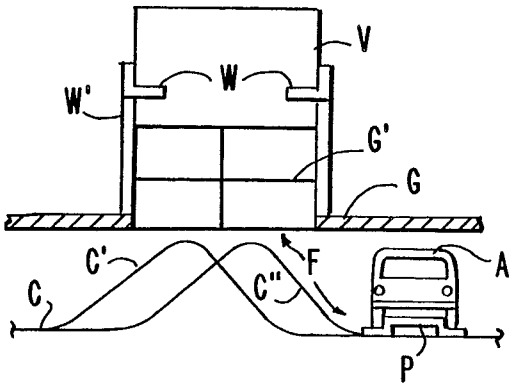
Figure 2B:
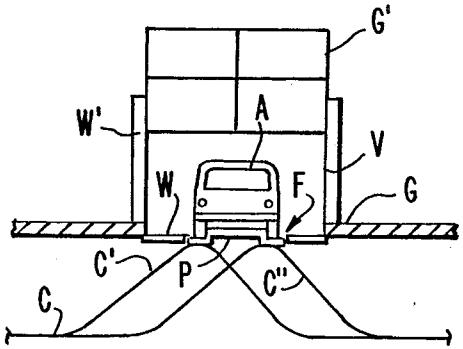
Figure 2A:
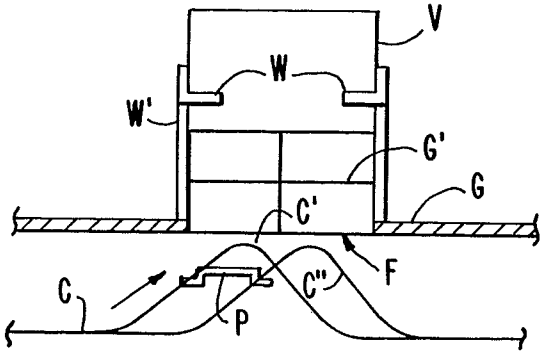
Figure 3:
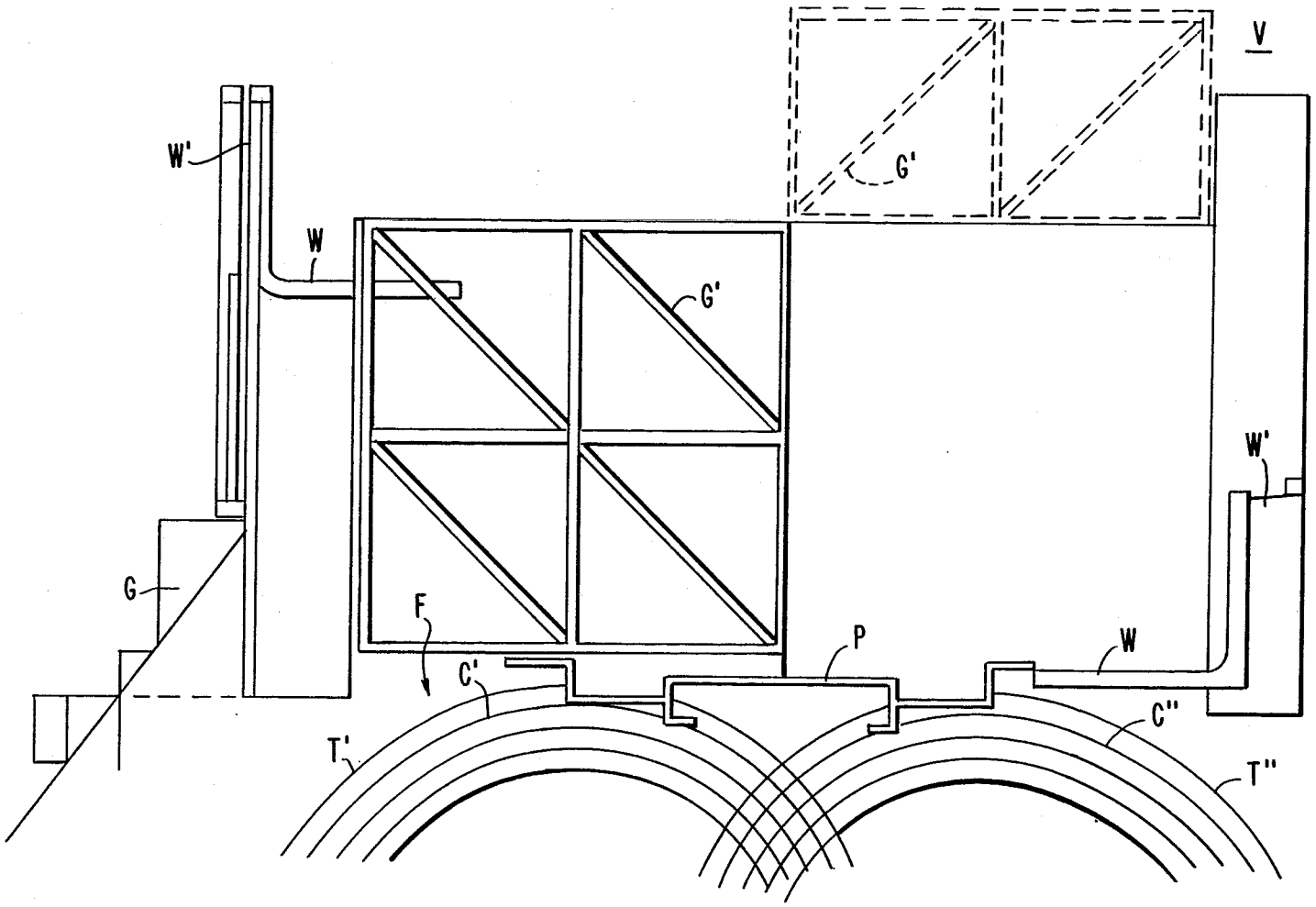
Figure 4A:
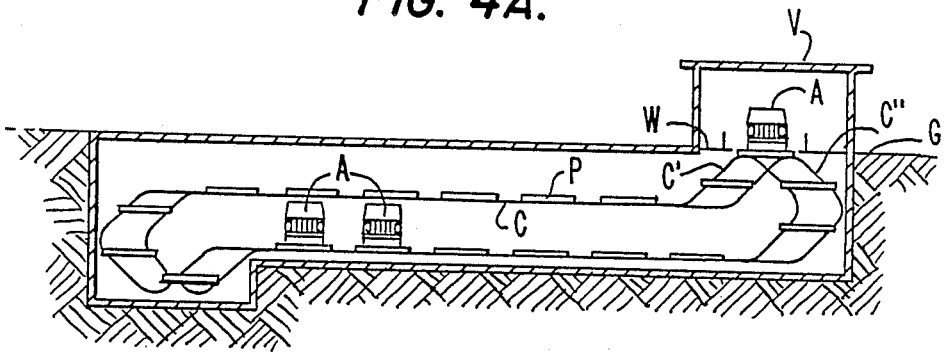
Figure 4B:
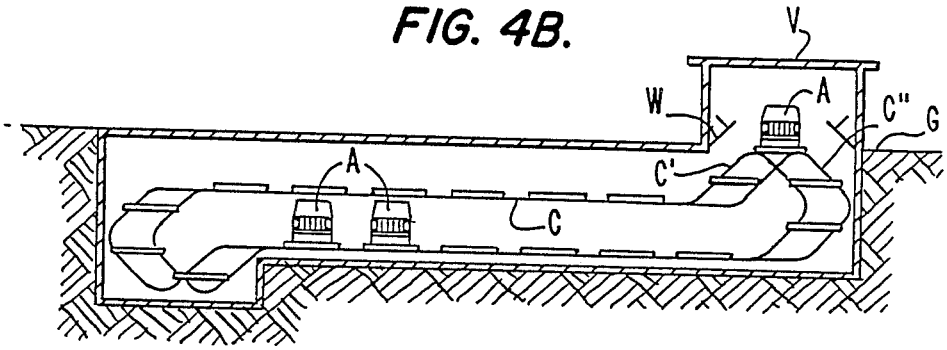
Figure 4C:
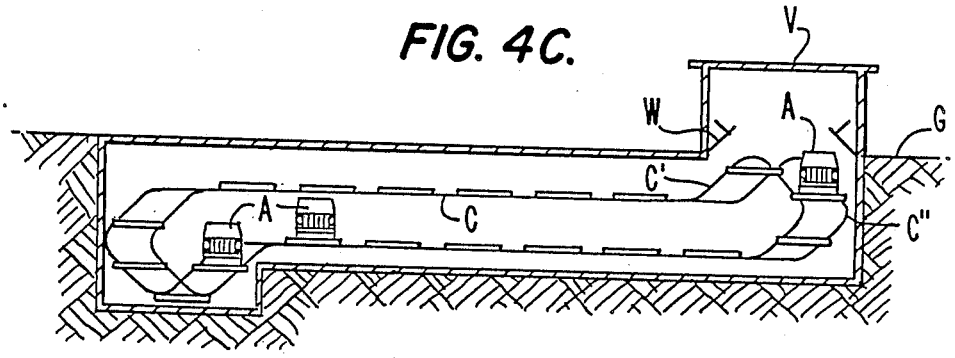
Figure 4D:
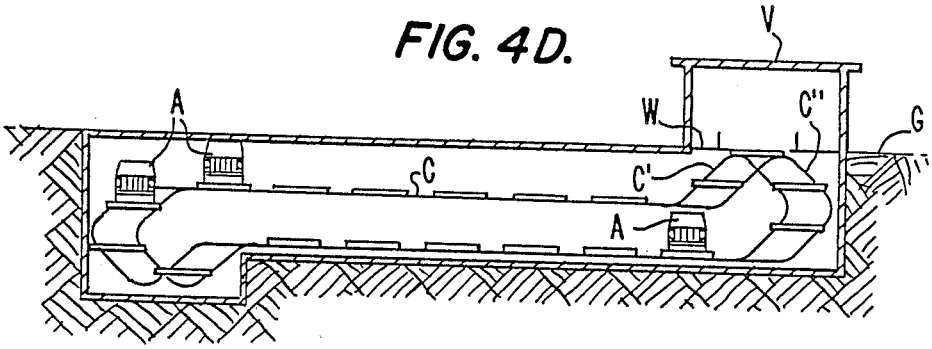
Figure 5:
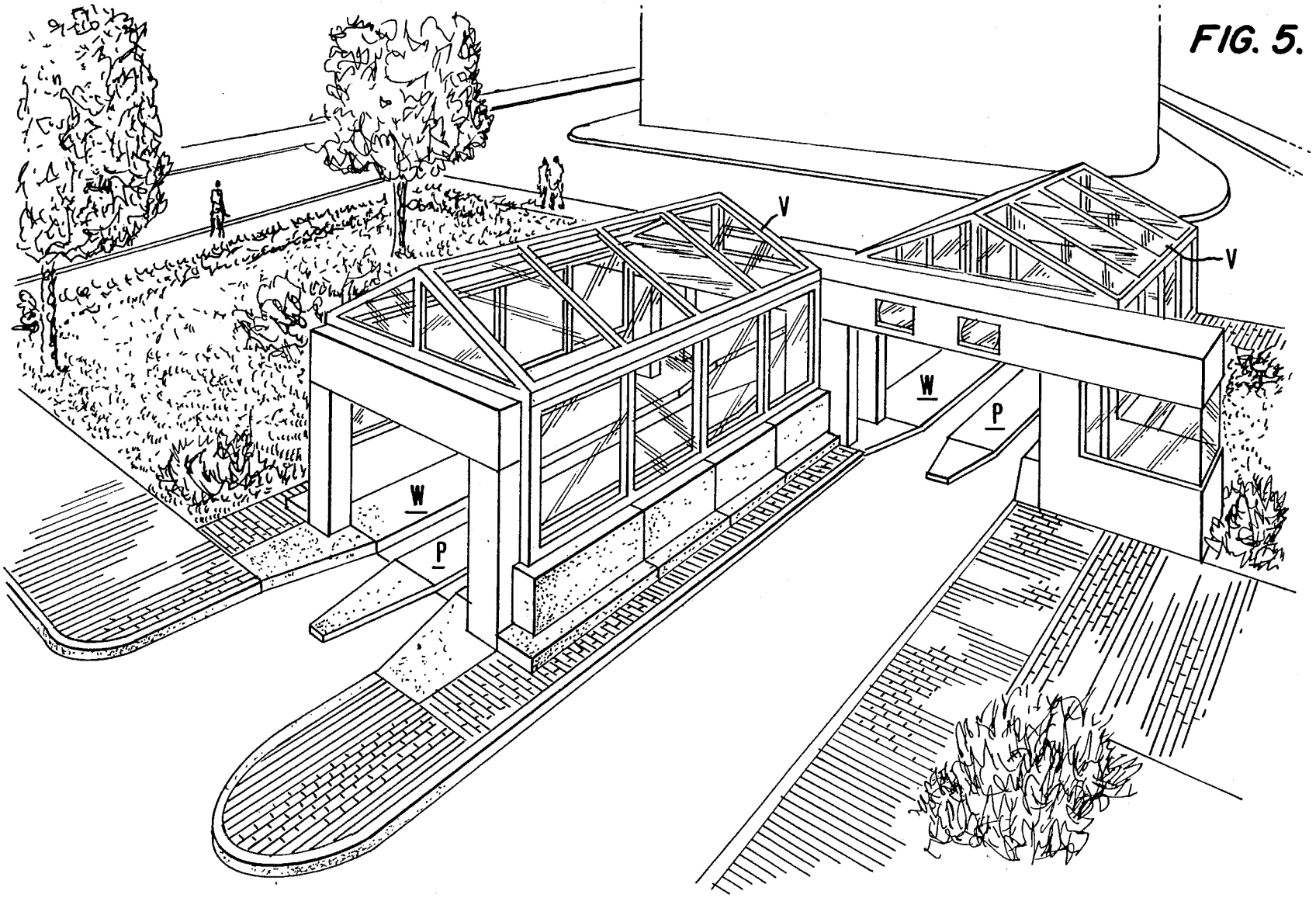

The invention will now be described with reference to the accompanying drawing, of which FIGS. 1A–1C are schematic diagrams showing the application of the delivery vestibule system and method of the invention to retrieval of an automobile from conveyor storage;

FIG. 2A–2C are similar views for parking;

FIG. 3 is a cross-sectional view of preferred conveyor loop and walkway apparatus for practicing the invention; and FIGS. 4A–D are longitudinal sections of a complete underground conveyor and surface vestibule system similar to the fragmentary views of FIGS. 1A–C and 2A–C; and FIG. 5 is an isometric view of a pair of vestibules operable with adjacent pairs of underground conveyors of the present invention.

Referring to FIGS. 1A–1C, a vestibule delivery volume is shown schematically at V, with access (and egress) at ground level G, and the conveyor storage and delivery structure C below ground. The conveyor structure may assume the form of transversely spaced parallel closedloop pairs of chain roller-link conveyors C traveling in corresponding parallel closed-loop tracks one below each of the opposite access sides of the vestibule V, and carrying the successive platforms transversely supported therebetween, as described in said Letters Patent.

The conveyor system C carries such successive platforms P, shown side or edge-on in FIGS. 1A–1C, along longitudinally extending paths past and under the vestibule V. In accordance with the technique of the invention, the floor area F of the vestibule is open. The successive platforms P are conventionally carried from the left-hand longitudinal section and split into paths extending transversely upwardly along a pair of partially overlapping adjacent loops C′ and C″ into the floor area F, FIG. 1B, and then transversely downwardly and merging back into the longitudinal path at the right-hand side, FIG. 1C. With the sides of the platforms P being attached and carried by the chains of the conveyor loops C′ and C″ (attachment being effected, for example, as described in said Letters Patent), stable horizontal orientation of the platform is maintained as it is elevated to the floor area F and then carried back down again—essential for the automobile storage or similar applications.

In FIG. 1A, a preselected stored automobile A has been called for delivery at the vestibule V, FIG. 1B, by the attendant, as upon the request of the car owner. When the platform P (carrying the desired car A) reaches and at least partially fills the vestibule floor area F, the platform being of less area generally then the open floor area, the same is stopped for enabling access to the vestibule, as by conventional computer command or attendant control of the drive, schematically shown at D. Coincident with and in response to the stopping of the pre-selected platform P at the floor area F, side walkways W for insertion in or filling the remaining exposed space of the floor area on both sides of the platform, are lowered (as by a vertical pulley or chain drive, or alternatively a tilting or revolving system, not shown), along columns W' on the side vestibule walls from an upper storage position, FIG. 1A, to alinement with the stopped platform, FIG. 1B. Substantially simultaneously, a gate G' at the front or entrance access wall (and a similar gate on the opposing egress or exit wall, not shown) is raised or opened, FIG. 1B, (or alternatively laterally slid open, not shown), so that the car owner may safely, and without assistance of an attendant, enter the vestibule and drive the car A off, whereupon the gate G' is lowered, the walkways W are then raised or otherwise withdrawn, as by upward elevating by tilting, FIGS. 4B and C, and the conveyor C causes the platform to be carried downwardly, to join the right-hand longitudinal section of the conveyor, FIG. 1C.

The same sequence performed for parking and storing a car on an unoccupied platform is shown in FIGS. 2A–2C; it being understood that the design of the invention, while shown applied to conveyor movement from left to right in the upper section of the overall longitudinal conveyor loop C, is also adapted for reverse-direction movement as where the preselected platform can be delivered to the vestibule V in a shorter time by such reversal of direction of conveyor travel.

A complete system is shown in side elevation in FIGS. 4A–4D. A car A has been driven into the vestibule V (FIG. 4A) with the conveyor C at rest and a platform P stopped in the vestibule at floor level and with the walkways W lowered to floor level (the gate, not shown, being open). The driver then leaves the vestibule. In FIG. 4B, the process of receiving the car for storage is commenced with the conveyor C still at rest, but about to start, and the walkways W raised and the gate, not shown, lowered. The conveyor C is traveling in FIG. 4C with the walkways W still raised and the gate still closed; while in FIG. 4D, the car is in underground storage, a new platform is stopped at floor level in the vestibule, and the walkways are again lowered and the gate raised. This would be the condition shown in FIG. 5 for receiving cars-to-be-stored.

In the drawing of FIG. 3, a practical embodiment is shown in which the upper portions of the partially overlapping successive transverse conveyor loops C' and C'' are illustrated as roller-link chains (as in said Letters Patent) traveling within corresponding C-shaped tracks T' and T'', supporting the platform P in the floor area F of the vestibule V. For illustrative and explanatory purposes only, the left-hand portion of gate G' is shown down and the left-hand walkway in stored upper position, and the right-hand portion of gate G' is shown dotted and raised coincident with the lowered right-hand walkway W, whereas, of course, in practice, the left and right-hand gate portions and walkways will operate in unison. Well-known details of platform-to-chain attachment and the like, as disclosed in said Letters Patent, are omitted in order not to detract from the novel features of the method and system of the invention; it being understood, of course, that the drawings are taken from the entrance side only of the conveyor and vestibule structures, and that, as illustrated in said Letters Patent and previously described herein, a similar parallel conveyor structure C-C'-C'' is disposed under and along the egress side of the vestibule, with the platforms P carried transversely therebetween (into the drawings of FIGS. 1A–2C), and the walkways W extending between the entrance access and egress access vestibule sides, FIG. 5.

For automobile garaging purposes, suitable angles of rise (and descent) for the conveyor loops C'-T' and C''-T'' have been found to be about 54° to the horizontal, with the open floor area horizontal dimension about 20 feet and the horizontal distance between the uppermost portions of the loops C' and C'' about 6 feet when using seven foot-two inch wide platform and three foot wide sidewalks. Other dimensions for modified vestibule sizes, other vestibule geometries particularly adapted for other applications, including an open delivery wall other than the floor, and further modifications will occur to those skilled in this art, such being considered to fall within the spirit and scope of the invention as defined in the appended claims.

What is claimed is:

1. In a garage apparatus for automobiles in which a vestibule is provided for the entrance and exit of automobiles to and from a garage, the vestibule having a bottom opening through which automobiles are lowered and raised, a conveyor system comprising parallel continuous loop conveyors each including a transverse elevator section below said bottom opening of said vestibule and a pair of longitudinal sections extending substantially horizontally from opposite ends of said elevator section so that said elevator section is intermediate said longitudinal sections, a series of automobile-carrying platforms extending between and mounted on said conveyors, drive means for operating said conveyors to move said platforms therealong, each of said elevator sections including a pair of longitudinally staggered incline-decline means for raising said automobile-carrying platforms from said longitudinal sections substantially to the level of said bottom opening of said vestibule and for lowering said platforms to said longitudinal sections, said drive means having means for stopping said conveyors with any one of said platforms aligned with said bottom opening of said vestibule, each platform having an area less than the area of said bottom opening, means operable when one of said platforms is moved to alignment with said bottom opening for inserting walkway means beside said one platform and aligned therewith to permit access thereto and therefrom, and means for removing said walkway means from beside said one platform when said one platform is to be moved from alignment with said opening.

2. A system in accordance with claim 1, wherein said drive means is located adjacent to an end portion of said conveyors remote from said elevator sections.

3. A system in accordance with claim 1, wherein said walkway means comprises a pair of walkways disposed at opposite sides of said one platform and stored elevated from said bottom opening along side walls of the vestibule, the walkway inserting means comprising means for lowering the walkways at opposite sides of said one platform, and said removing means comprising means for elevating the walkways.

4. A system in accordance with claim 3, wherein said elevating and lowering means operate in a vertical direction parallel to said side walls.

5. A system in accordance with claim 3, wherein said elevating and lowering means tilt said walkways upwardly and downwardly adjacent to said side walls.

6. A system in accordance with claim 1, further comprising gate means for providing access to said one platform only when said walkway means has been inserted.

* * * * *